US005769338A

United States Patent [19]

Yashima et al.

[11] Patent Number: 5,769,338

[45] Date of Patent: Jun. 23, 1998

[54] PULVERULENT BODY PROCESSING APPARATUS AND METHOD OF MANUFACTURING A SLIT MEMBER TO BE USED FOR THE SAME

[75] Inventors: Saburoh Yashima, 2-8, Nichenchaya, Wakabayashi-ku, Sendai-shi, Miyagi-ken; Manabu Abe, Miyagi-ken; Katsumi Ueta, Tokyo; Kantaro Kaneko, Sakai, all of Japan

[73] Assignees: S Fimatec Ltd.; a part interest; Saburoh Yashima; a part interest; Kurimoto, Ltd., all of, Japan; a part interest

[21] Appl. No.: 555,838

[22] Filed: Nov. 13, 1995

[30] Foreign Application Priority Data

Nov. 14, 1994 [JP] Japan ..... 6-304315
Nov. 14, 1994 [JP] Japan ..... 6-304316

[51] Int. Cl.[6] ..... B02C 17/16

[52] U.S. Cl. ..... 241/69; 241/79; 241/172

[58] Field of Search ..... 241/69, 79, 171, 241/172

[56] References Cited

U.S. PATENT DOCUMENTS

| | | | |
|---|---|---|---|
| 3,799,455 | 3/1974 | Szegvari . | |
| 3,964,717 | 6/1976 | Hansen . | |
| 5,016,826 | 5/1991 | Michelsen et al. | 241/72 |
| 5,257,742 | 11/1993 | Yashima et al. | 241/65 |
| 5,292,077 | 3/1994 | Inui et al. | 341/72 |
| 5,361,996 | 11/1994 | Svensson et al. | 241/30 |
| 5,518,191 | 5/1996 | Bartsch et al. | 241/46.11 |

FOREIGN PATENT DOCUMENTS

| | | |
|---|---|---|
| 1247 822 | 8/1967 | Germany . |
| 2151335 | 4/1972 | Germany . |
| 28 34 726 | 2/1979 | Germany . |
| 33183312 | 11/1983 | Germany . |
| 3624229 | 1/1988 | Germany . |
| 6-012993 | 1/1994 | Japan . |
| 6-036692 | 2/1994 | Japan . |
| WO 93/07334 | 4/1993 | WIPO . |

OTHER PUBLICATIONS

"Klystrons pour emetteurs de television", F. Gaillon, Electronic Et Applications Industrielles, No. 255, Jun. 1978, pp. 17–21.

*Primary Examiner*—John M. Husar
*Attorney, Agent, or Firm*—Reid & Priest LLP

[57] ABSTRACT

There is provide an improved pulverulent body processing apparatus that is substantially free from abrasion and cleavage of the pulverizing medium to allow prolonged continuous operation and also free from small pieces of the slit member and the pulverizing medium that can be produced as a result of such abrasion and cleavage and mixed with the material being pulverized and hence can efficiently operate to produce an evenly pulverized product. Such a pulverulent body processing apparatus comprises a vertically arranged cylindrical housing, a slit member having one or more than one slits sized to prevent unit members of a pulverizing medium from passing therethrough and arranged at the bottom of the cylindrical housing, a rotary shaft arranged along the axis of the cylindrical housing and a plurality of bladed stirring members arranged vertically and secured to the rotary shaft and is characterized in that said slit or each of said slits is arranged in a flat disc and has a radial width sized to prevent unit members of the pulverizing medium from passing therethrough and a peripheral width greater than the radial width.

13 Claims, 9 Drawing Sheets

PULVERULENT BODY PROCESSING APPARATUS AND METHOD OF MANUFACTURING A SLIT MEMBER TO BE USED FOR THE SAME

BACKGROUND OF THE INVENTION

1. Field of the Invention

This invention relates to a pulverulent body processing apparatus and a method of manufacturing a slit member to be used for such an apparatus and, more particularly, it relates to a pulverulent body processing apparatus that can effectively refine a pulverulent body and provide it with various characteristic features by ultra-finely pulverizing one or more than one materials, compounding, modifying and mixing pulverized materials and binding them to a given form in a controlled manner.

2. Prior Art

With any known pulverulent body processing technique, be it a dry or wet method, the operation of ultra-finely pulverizing one or more than one materials, compounding, modifying and mixing pulverized materials and binding them to a given form in a controlled manner is a highly energy intensive process and the yield is low to undesirably boost the manufacturing cost and reduce the technique industrially unfeasible. Therefore, such techniques have been tried only on a laboratory basis to produce a pulverulent body to a small amount.

In an attempt to dissolve the above problem, Japanese Patent Publication No. 5-253509 discloses a flow-type medium stirring/pulverizing machine comprising a wedge wire stainless screen as a web member that takes a role corresponding to that of a slit member according to the invention. A wedge wire stainless screen as defined in the above cited patent document is prepared by welding stainless wires having a wedge-like cross section to form a grating in such a way that the space formed by any two adjacent wires is broadened toward the downward.

However, a flow-type medium stirring/pulverizing machine as described above cannot be operated continuously for a prolonged period of time because of abrasion and cleavage that can eventually appear on the pulverizing medium mainly due to the fact that the web member does not show a planar surface and have perpendicularly parallelepipedic openings. As small pieces of the pulverizing medium are given rise to by abrasion and cleavage and mixed with the material being pulverized, the latter can become qualitatively degraded to an unacceptable degree.

Japanese Patent Publication No. 5-253509 proposes an improved flow-type medium stirring/pulverizing machine, wherein the distance separating the front end of each of the bladed stirring members and the cylindrical housing and the distance between the lower edge of the lowest bladed stirring member 18 or 20 and the slit member 16 are held to be between ⅔ of the diameter of the pulverizing medium and 0. In this case, the product of the distance between the front end of each of the bladed stirring members and the cylindrical housing divided by the diameter of the unit member of the pulverizing medium, or non-dimensional clearance number as will be described hereinafter, is between 0.67 and 0. The product of the distance between the lower edge of the lowest bladed stirring member and the slit member divided by the diameter of the unit member of the pulverizing medium, or non-dimensional clearance number as will be described hereinafter, is also between 0.67 and 0.

With a flow-type medium stirring/pulverizing machine proposed in the above cited patent document, again, abrasion and cleavage can eventually appear on the pulverizing medium to prohibit the machine from prolonged continuous operation. If small pieces of the pulverizing medium are produced as a result of abrasion and cleavage and mixed with the material being pulverized, the latter can become qualitatively degraded to an unacceptable degree.

PROBLEMS TO BE SOLVED BY THE INVENTION

In view of the above identified problems of known pulverulent body processing apparatuses, it is therefore the object of the present invention to provide an improved pulverulent body processing apparatus that is substantially free from abrasion and cleavage of the pulverizing medium to allow prolonged continuous operation and also free from small pieces of the slit member and the pulverizing medium that can be produced as a result of such abrasion and cleavage and mixed with the material being pulverized and hence can efficiently operate to produce an evenly pulverized product.

SUMMARY OF THE INVENTION

According to a first aspect of the invention, the above object is achieved by providing a pulverulent body processing apparatus comprising a vertically arranged cylindrical housing, a slit member having one or more than one slits sized to prevent unit members of a pulverizing medium from passing therethrough and arranged at the bottom of the cylindrical housing, a rotary shaft arranged along the axis of the cylindrical housing and a plurality of bladed stirring members arranged vertically and secured to the rotary shaft, characterized in that said slit or each of said slits is arranged in a flat disc and has a radial width sized to prevent unit members of the pulverizing medium from passing therethrough and a peripheral width greater than the radial width.

In a preferred mode of carrying out the invention, said peripheral width of said slit or each of said slits extends to substantially 360°. In another preferred mode of carrying out the invention, a plurality of concentric circular slits are arranged in said slit member. In still another preferred mode of carrying out the invention, a single spiral slit is arranged in said slit member. In still another preferred mode of carrying out the invention, said slit or each of said slits has a trapezoidal cross section having a large bottom edge. In a further preferred mode of carrying out the invention, said slit member is provided under its lower surface with a radially extending reinforcing member.

According to a second aspect of the invention, there is provided a method of manufacturing a slit member to be fitted to the bottom of the housing of a pulverizing apparatus and sized to prevent unit members of a pulverizing medium from passing therethrough, characterized in that said slit member is formed by cutting one or more than one slits through a flat plate by means of a water jet system.

In a preferred mode of carrying out the invention, said water jet system comprises a nozzle for shooting a liquid or a mixture of a liquid and an abrasive. In another preferred mode of carrying out the invention, a spiral slit is formed as said flat plate is rotated continuously. In still another preferred mode of carrying out the invention, concentric circular slits are formed as said flat plate is rotated continuously.

According to a third aspect of the invention, there is provided a pulverulent body processing apparatus comprising a vertically arranged cylindrical housing, a slit member having one or more than one slits sized to prevent unit members of a pulverizing medium from passing therethrough and arranged at the bottom of the cylindrical housing, a rotary shaft arranged along the axis of the cylindrical housing and one or more than one bladed stirring members secured to the rotary shaft, characterized in that the front end of said bladed stirring member or each of said bladed stirring members and the inner wall of the cylindrical housing has a relationship of $$2 \leqq wh/Db \leqq 16,$$

where wh is the distance between the front end of the bladed stirring member and the inner wall of the cylindrical housing and Db is the maximum diameter of each unit member of the pulverizing medium.

In a preferred mode of carrying out the invention, a plurality of vertically arranged bladed stirring members are provided. In another preferred mode of carrying out the invention, a number of vertically bladed stirring members and the same number of obliquely bladed stirring members for stirring up the pulverizing medium are alternately arranged in a vertical direction.

According to a fourth aspect of the invention, there is provided a pulverulent body processing apparatus comprising a vertically arranged cylindrical housing, a slit member having one or more than one slits sized to prevent unit members of a pulverizing medium from passing therethrough and arranged at the bottom of the cylindrical housing, a rotary shaft arranged along the axis of the cylindrical housing and a plurality of bladed stirring members arranged vertically and secured to the rotary shaft, characterized in that the lower edge of the lowest bladed stirring member and the slit member has a relationship of $$1.5 \leqq wb/Db \leqq 8,$$

where wb is the distance between the lower edge of the lowest bladed stirring member and the upper surface of the slit member and Db is the maximum diameter of each unit member of the pulverizing medium.

In a preferred mode of carrying out the invention, the number of said bladed stirring members is equal to or more than two. In still another preferred mode of carrying out the invention, said slit or each of said slits is arranged in a flat disc and has a radial width sized to prevent unit members of the pulverizing medium from passing therethrough and a peripheral width greater than the radial width. In still another preferred mode of carrying out the invention, a number of vertically bladed stirring members and the same number of obliquely bladed stirring members for stirring up the pulverizing medium are alternately arranged in a vertical direction.

With a pulverulent body processing apparatus according to the invention, the pulverizing medium is substantially free from abrasion and cleavage and hence the apparatus can be operated continuously for a prolonged period of time so that no scraped small pieces of the slit members and the pulverizing medium may be produced and mixed with the material being processed to allow the latter to be pulverized evenly and efficiently.

DESCRIPTION OF THE BEST MODE OF CARRYING OUT THE INVENTION

Now, the present invention will be described by referring to the accompanying drawings that illustrate a preferred embodiment of pulverulent body processing apparatus according to the invention.

[Configuration of the Apparatus]

Figure 1:
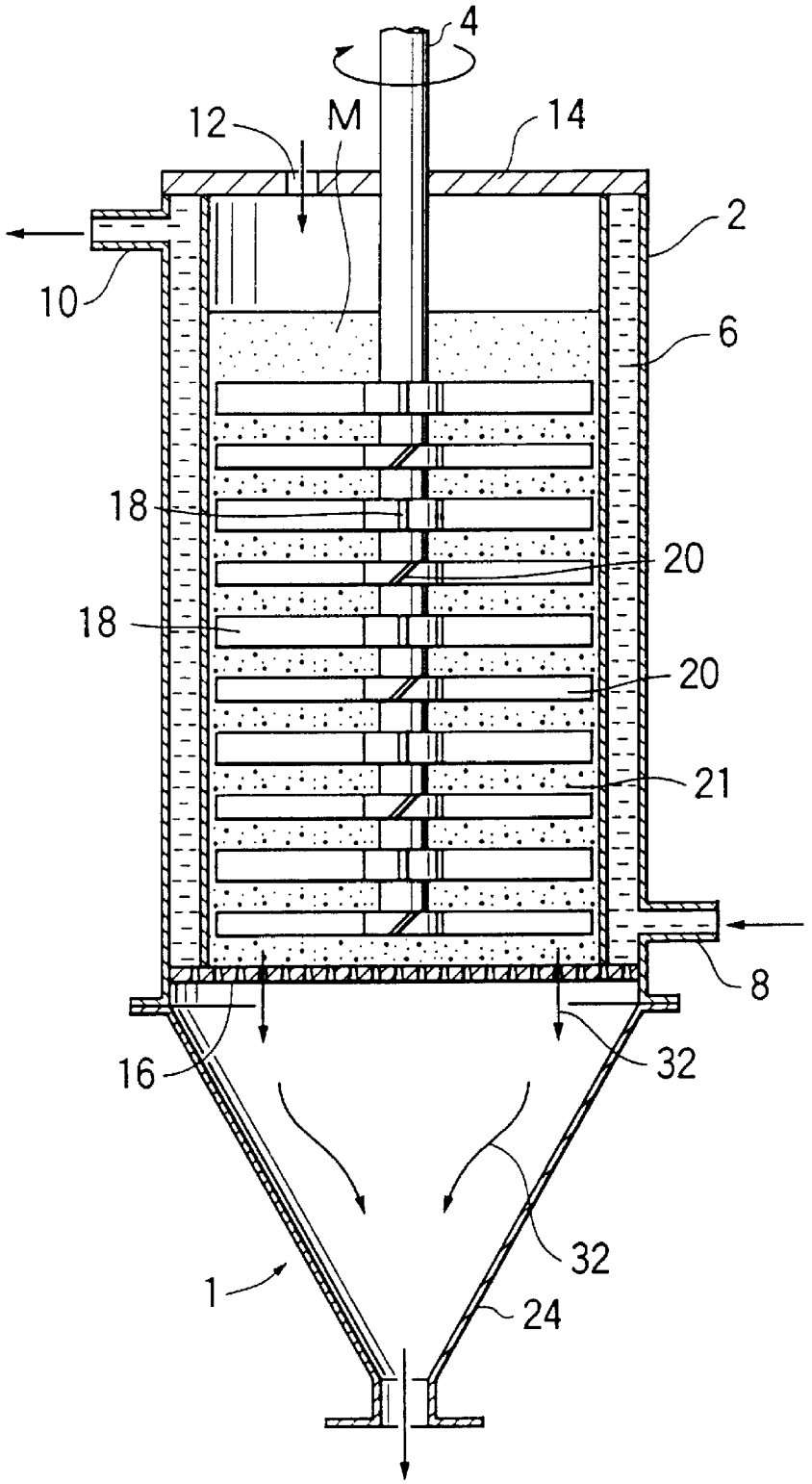
FIG. 1 is a schematic lateral cross sectional view of an embodiment of pulverulent body processing apparatus according to the invention.

Referring firstly to FIG. 1, reference numeral 1 generally denotes a pulverulent body processing apparatus that comprises a cylindrical housing 2 having a vertical axis and containing a rotary shaft 4 arranged along the axis. The lateral side of the cylindrical housing 2 has a double wall structure and cooling liquid 6 or heating liquid is fed to the gap between the two walls through an inlet pipe 8 and made to circulate there before it is discharged via an outlet pipe 10.

The cylindrical housing 2 is closed at the top by a closure member 14 provided with a feeding port 12 for feeding material M and provided at the bottom with a slit member 16 having one or more than one slits sized to prevent unit members of a pulverizing medium 21 from passing therethrough.

The rotary shaft 4 of the cylindrical housing 2 is provided with vertically arranged five vertically bladed stirring members 18 and five obliquely bladed stirring members 20, the vertically and obliquely bladed stirring members 18 and 20 being alternately disposed from above. The blades of the vertically bladed stirring members 18 are disposed vertically in parallel with the axis of the cylindrical housing 2, whereas those of the obliquely bladed stirring members 20 are disposed aslant relative to the axis of the cylindrical housing 2. For instance, each of the first, third and other odd-numbered bladed stirring members 18 is provided with five regularly spaced and radially arranged vertical blades, whereas each of the second, fourth and other even-numbered bladed stirring members 20 is provided with five regularly spaced and radially arranged oblique blades. The angle of inclination of the oblique blades 20 is so selected that they may optimally stir up the material M to be processed as they are driven to rotate by the rotary shaft 4.

As described above, the vertically bladed stirring members 18 and the obliquely bladed stirring members 20 are alternately arranged. More specifically, each of the first, third and other odd-numbered bladed stirring members 18 may be provided with five regularly spaced and radially arranged vertical blades, whereas each of the second, fourth and other even-numbered bladed stirring members 20 may be provided with five regularly spaced and radially arranged oblique blades.

The distance between the front end of each of the bladed stirring members 18 and 20 and the inner wall of the cylindrical housing 2 is held equal to a value between twice (2) and sixteen (16) times of the diameter of unit members of the pulverizing medium 21 at room temperature in order to prevent any clogging of the pulverizing medium 21 from taking place there. The distance between the lower edge of the lowest bladed stirring member 18 or 20 and the upper surface of the slit member 16 is held to a value between one and a half times (1.5) and eight (8) times of the diameter of unit members of the pulverizing medium 21. More specifically, assuming that the distance between the front end of each of the bladed stirring members 18 and 20 and the inner wall of the cylindrical housing 2 is wh mm and the distance between the lower edge of the lowest bladed stirring member 18 or 20 and the upper surface of the slit member 16 is wb mm and the maximum diameter of unit members of the pulverizing medium 21 is Db and wh/Db and wb/Db are defined as non-dimensional clearance numbers, the non-dimensional clearance numbers wh/Db and wb/Db are respectively between two (2) and sixteen (16) and between one and a half (1.5) and eight (8). As will be described hereinafter under the heading of [Result], the frequency with which unit members of the pulverizing medium 21 are trapped between the front ends of the bladed stirring members 18 and 20 and the inner wall of the cylindrical housing 2 and between the lower edge of the lowest bladed stirring member 18 or 20 and the slit member 16 remarkably increases when the non-dimensional clearance numbers wh/Db and wb/Db are smaller than the above defined respective limits and the pulverulent body processing apparatus 1 is operated for a long time, whereas the efficiency of pulverization of the apparatus is remarkably reduced when the non-dimensional clearance numbers wh/Db and wb/Db exceed the above defined respective limits.

A shoot for guiding the pulverized product 24 is arranged under the slit member 16. The product processed by the pulverulent body processing apparatus or the pulverized product 32 is delivered to the outside of the apparatus through this shoot 24.

Figure 2:
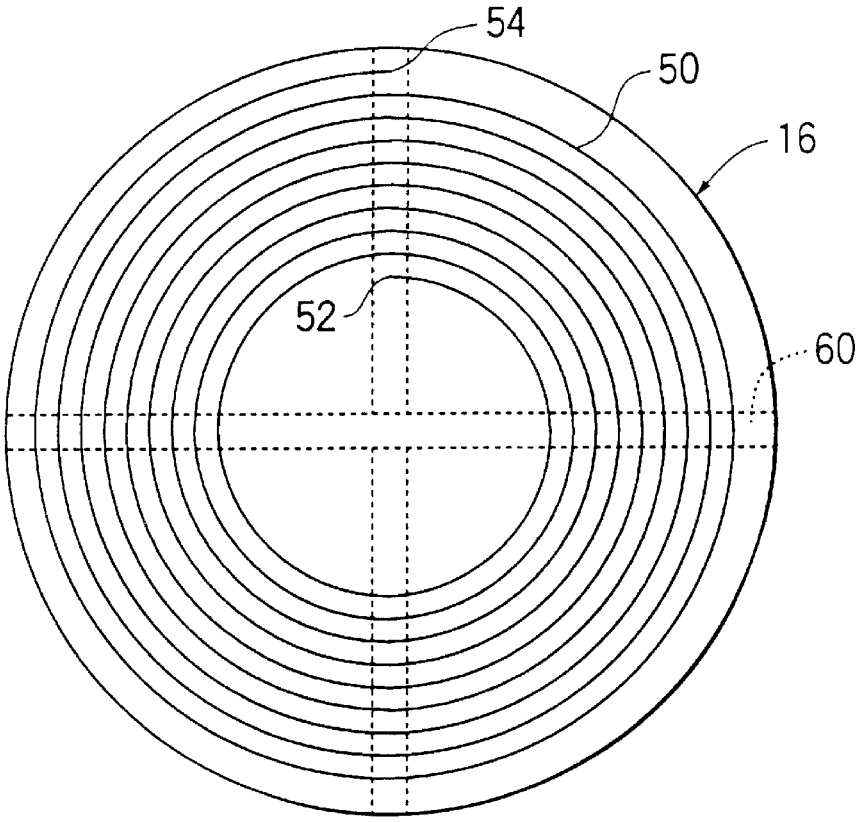
FIG. 2 is a schematic plan view of an embodiment of slit member according to the invention.
Figure 3:
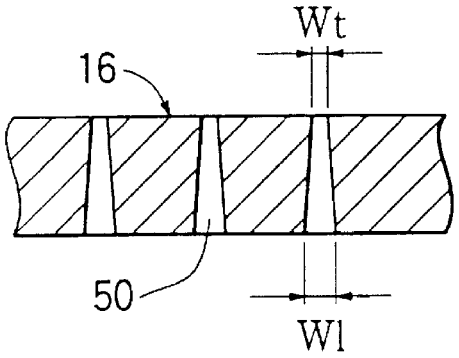
FIG. 3 is a schematic partial sectional view of the slit member of FIG. 2.

As shown in FIG. 2, the slit member 16 is prepared by cutting a spiral slit 50 through a stainless steel disc with a thickness of 8 mm. The slit 50 spirally proceeds from a starting point 52 located close to the center of the slit member 16 to a terminal point 54 close to the periphery of the slit member 16 in the sense of rotation of the rotary shaft 4. The slit 50 has a trapezoidal cross section as shown in FIG. 3 with an upper slit width of Wt (mm) and a lower slit width of Wl (mm) as listed in the table below. A cross-shaped stainless steel reinforcing member 60 is welded to the underside of the slit member 16. From the viewpoint of strength, the starting and terminal points 52 and 54 of the spiral slit 50 is preferably found on the reinforcing member 60.

The slit 50 of the slit member 16 is cut from the underside by means of a water jet and thereafter the reinforcing member 60 is welded to the slit member 16. A water jet is a machine tool designed to shoot a narrow water jet stream under a pressure of several thousands kgf/cm$^2$ with a predetermined angle relative to the surface of an object to be processed in order to bore a hole and/or cut the object with the impact of the jet stream.

Figure 4:
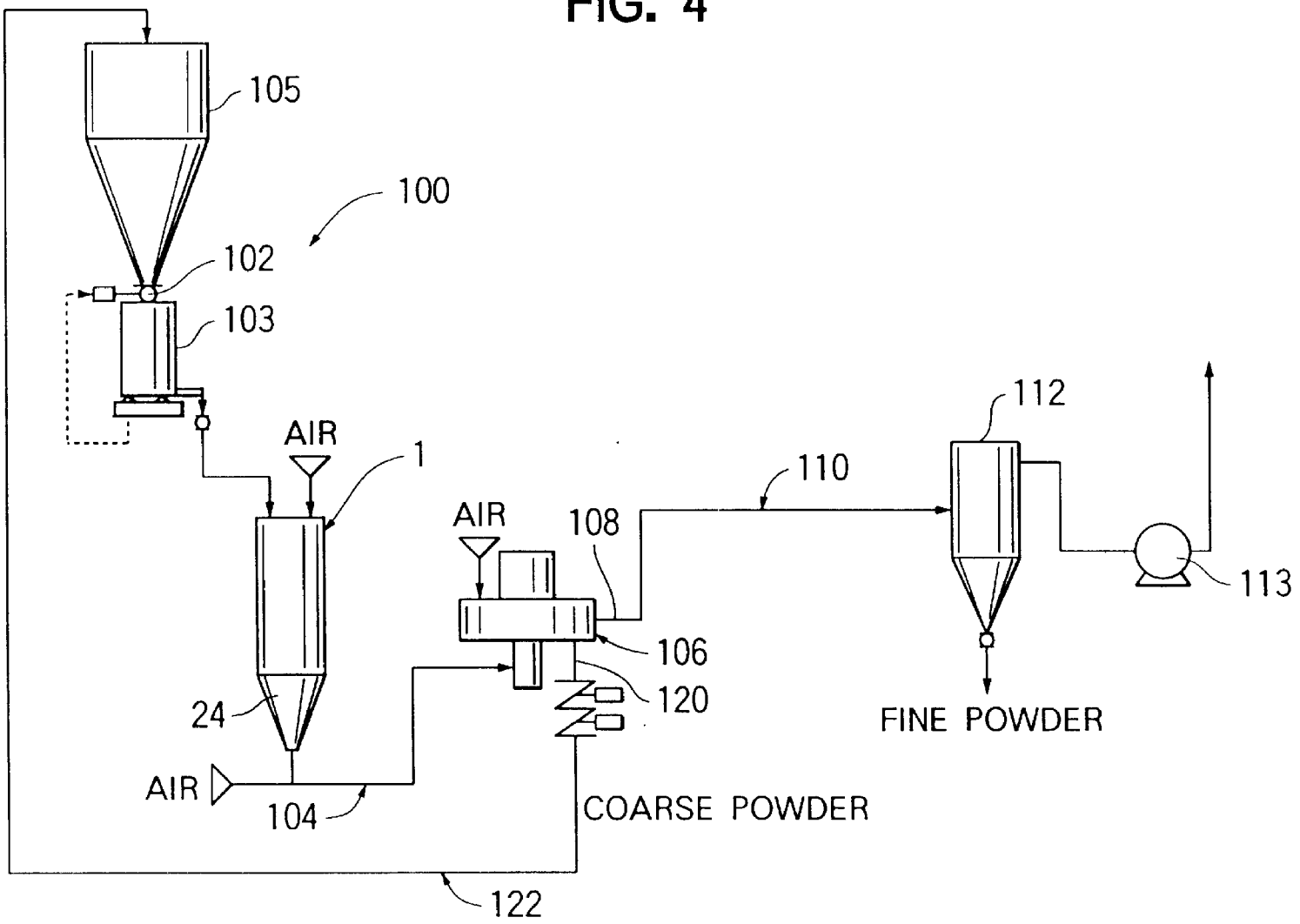
FIG. 4 is a schematic diagram of a pulverizing system comprising an embodiment of pulverulent body processing apparatus according to the invention.

FIG. 4 is a schematic block diagram of a pulverulent body processing system 100 comprising a pulverulent body processing apparatus 1 according to the invention and designed to effectively operate the apparatus. As shown in FIG. 4, otherwise it comprises a raw material container 105 for containing material M to be pulverized, said container 105 being provided at the bottom thereof with a rotary valve 102. The material M coming out of the rotary valve 102 is temporarily stored in a feeder 103 having a weighing capability so that the material M may be fed at a constant rate from there. The feeder 103 is directly connected to the pulverulent body processing apparatus 1. The shoot for guiding the pulverized product 24 is connected to a dry-type forced swirling air classifier 106 by way of a first air transport channel 104. Fine powder discharge port 108 of the dry-type forced swirling air classifier 106 is linked to a bag filter 112 by way of a second air transport channel 110. Fine power contained in the pulverized product transported by air to the bag filter 112 is collected by the filter and the sorted clean air is discharged into the atmosphere by means of a blower 113. Coarse powder discharge port 120 of the dry-type forced swirling air classifier 106 is connected to the raw material container 105 by way of a third air transport channel 122.

Some of the specifications of the pulverulent body processing apparatus 1 are listed below.

(1) cylindrical housing 2 inner diameter: 200 mm internal height: 770 mm (2) slit 50:

upper slit width Wt: 0.5 mm lower slit width Wl: 1.0 mm (3) stirring blades 18, 20 vertical width (height):

vertical stirring blade 18 . . . 42 mm oblique stirring blade 20 . . . 37 mm distance between adjacently arranged bladed stirring members: 65 mm (4) rate of rotation of bladed stirring members 18, 20 70–700 rpm (5) pulverizing medium 21 small alumina balls with diameters 1 mm, 2 mm, 3 mm, 10 mm true specific gravity of small alumina balls: 3.60

[Operation]

In the pulverulent body processing apparatus 1, tap water is fed into the gap between the two walls of the cylindrical housing 2 as cooling liquid 6 through an inlet pipe 8 and caused to circulate there before discharged through an outlet pipe 10 in order to control the internal temperature of the cylindrical housing 2. On the other hand, a pulverizing medium 21 is fed into the cylindrical housing 2 via a feeding port 12 and subsequently material M to be processed is also fed into the cylindrical housing 2 via the same feeding port 12. Then, the rotary shaft 4 is driven to rotate continuously. The material H and the pulverizing medium 21 are stirred together in the cylindrical housing 2 so that the material M is pulverized by the pulverizing medium 21 and only the pulverized product 32 is allowed to pass through the slit 50 of the slit member 16 and discharged to the outside from the shoot for guiding the pulverized product 24. If appropriate, the cooling liquid 6 is replaced by heating liquid to control the internal temperature of the cylindrical housing 2. Cooling or heating gas may be introduced into the cylindrical housing 2 by application of pressure or by suction in order to control the internal pressure more efficiently and effectively.

[Result 1]

A total of five hundred (500) experiments were carried out to determine the general performance of a pulverulent body processing apparatus 1 according to the invention. A dry-type filter was used for measuring the distribution of particle size of the material M to be processed and the pulverized product when the particle size was relatively large, whereas Microtrack SRA or SPA, a laser diffraction type particle size distribution analyzer available from Nikkiso Co., Ltd., was used when the particle size was relatively small. The material M to be processed consisted of #8 quartz sand and lime stone, each of which was fed at a rate of 6 kg/h.

Figure 5:
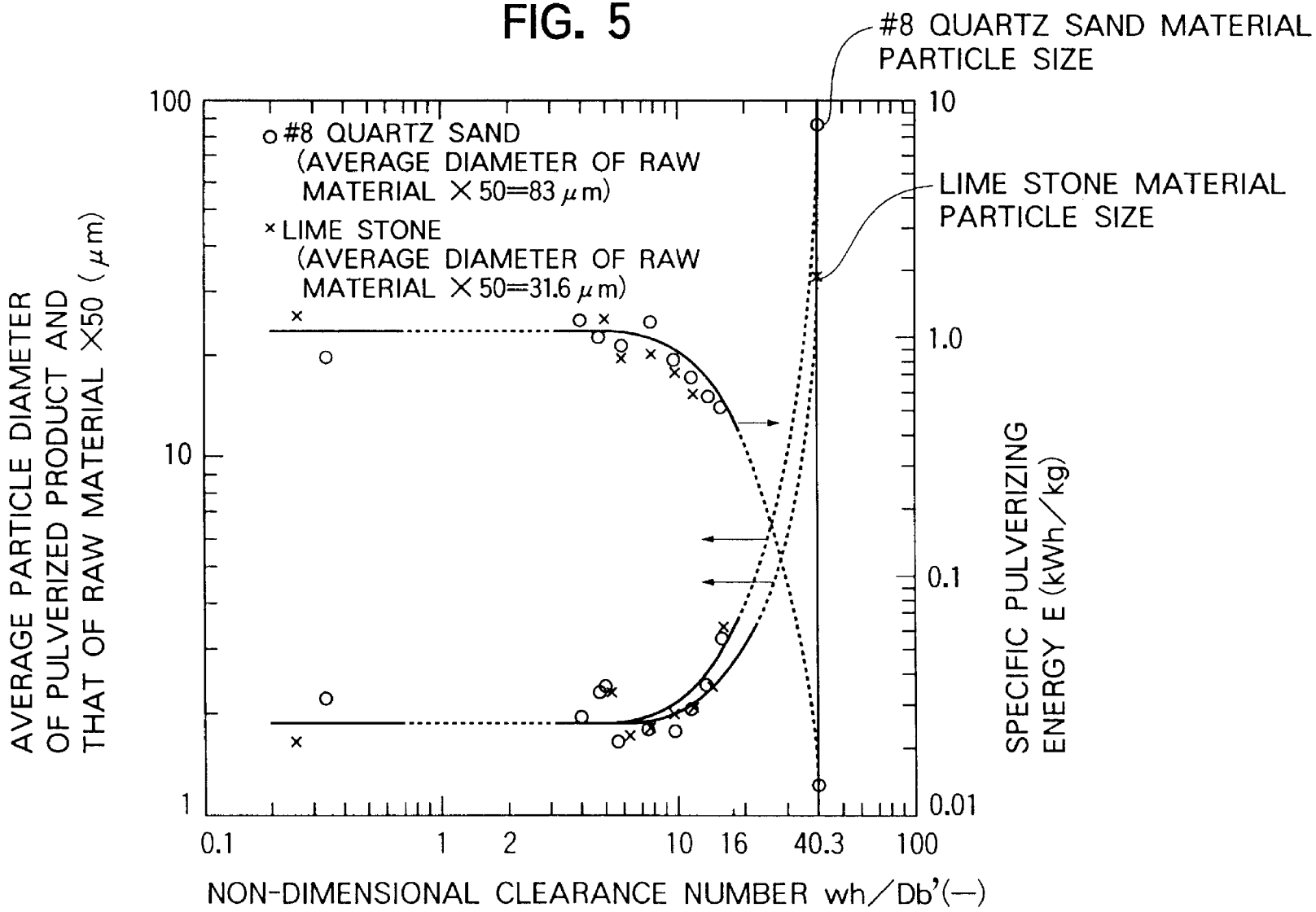
FIG. 5 is a graph showing the performance of a pulverulent body processing apparatus according to the invention.

FIG. 5 shows the relationship among the non-dimensional clearance number Wh/Db for the distance between the front end of the bladed stirring members 18 and 20 and the inner wall of the cylindrical housing (2) (horizontal axis) and the average particle diameter X50 and the specific pulverizing energy E (kWh/kg) of the pulverized product (vertical axis) determined as a result of the experiments. For the purpose of the present invention, specific pulverizing energy E (kWh/kg) is defined as the power consumed per hour by the pulverulent body processing apparatus 1 in order to pulverized a 1 kg of material H to a predetermined average particle size X50.

As clearly seen from FIG. 5, before the non-dimensional clearance number gets to wh/Db=10, the average particle size X50 of the pulverized product is X50=1.95 $\mu$m. When the non-dimensional clearance number wh/Db exceeds the above level, the average particle size X50 increases to produce coarse particles. This tendency is also observed on the specific pulverizing energy. E=0.95 kWh/kg is maintained before the non-dimensional clearance number gets to wh/Db=10, although a value around wh/db=16 is desirable from the viewpoint of pulverizing operation. If the average particle size X50 is not required to be very small, a satisfactory result can be achieved with a lower specific pulverizing energy E. D b' is the average diameter of pulverizing media.

Figure 6:
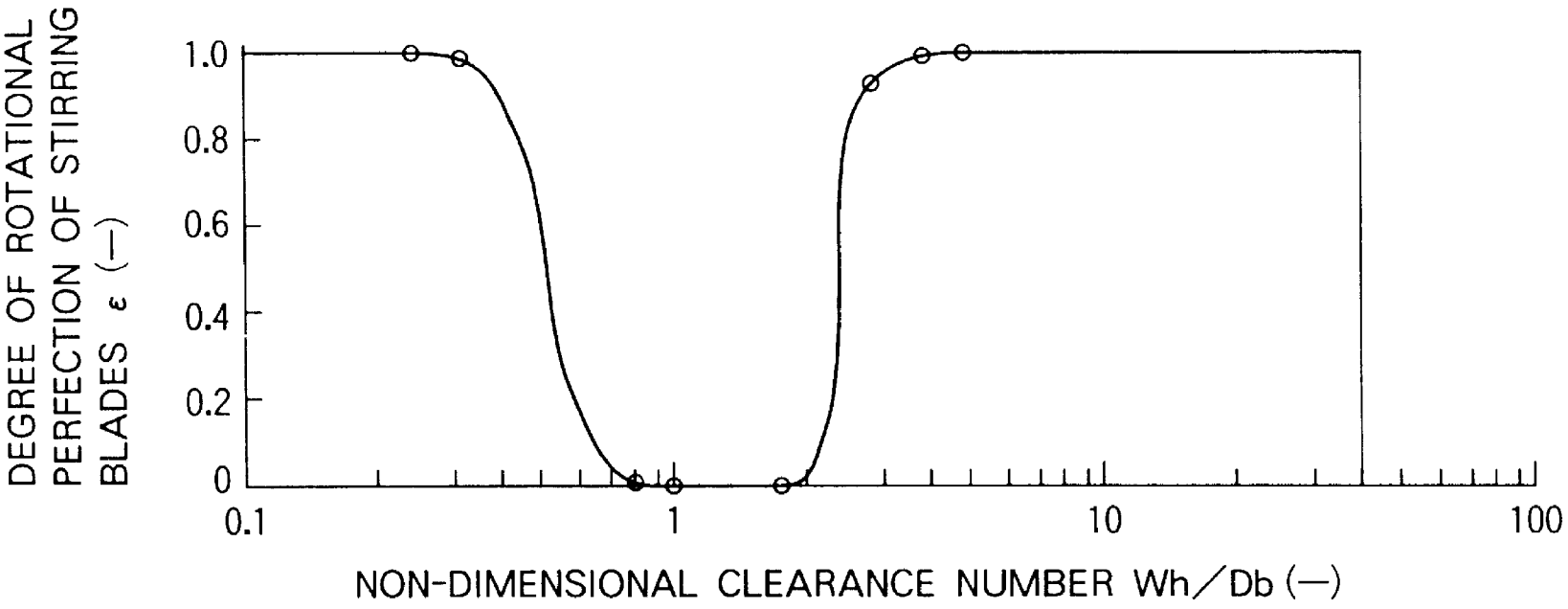
FIG. 6 is a graph showing the performance of the bladed stirring members of a pulverulent body processing apparatus according to the invention.

Fig. 6 is a graph showing the relationship between the non-dimensional clearance number wh/Db (horizontal axis) and the degree of perfection of the rotation of stirring blades $\epsilon$ (vertical axis). For the purpose of the invention, the degree of perfection of the rotation of stirring blades $\epsilon$ is 0 when the pulverizing medium is caught between the front end of any of the bladed stirring members and the inner wall of the cylindrical housing and hence the bladed stirring members cannot rotate at all and 1.0 when no pulverizing medium is trapped between them and hence the bladed stirring members can freely rotate. As seen from FIG. 6, the rotation of the bladed stirring members can become imperfect when the non-dimensional clearance number wh/Db is between 8 and 2 as the pulverizing medium 21 is caught between the front end of any of the bladed stirring members and the inner wall of the cylindrical housing. A perfect rotation can be realized when wh/Db exceeds 4 or so. In other words, wh/Db=2 or more is required solely from the viewpoint of the operation of the pulverulent body processing apparatus 1. The length of the stirring blades should be reduced to nil for a non-dimensional clearance number of wh/Db=40.3.

On the other hand, as for the non-dimensional clearance number wb/Db for the distance between the lower edge of the lowest bladed stirring member and the slit member 16, it should be noted that the pulverizing medium 21 found between the lower edge of the lowest bladed stirring member and the upper surface of the slit member 16 is driven toward the outer periphery of the slit member 16 or the inner wall of the cylindrical housing 2 by centrifugal force as it is rotated by the bladed stirring member so that it may not be easily caught between the lower edge of the lowest bladed stirring member and the upper surface of the slit member 16. Therefore, the bladed stirring members rotate smoothly if the non-dimensional clearance number is greater than wb/Db=1.5 and the pulverizing medium actively moves on the slit member to prevent the slit member from being clogged by the pulverized product. If, however, if the non-dimensional clearance number exceeds wb/Db=8, the frictional resistance appearing on the upper surface of the slit member 16 and the rotary force of the bladed stirring members are hardly transmitted to the pulverizing medium and the portion of the pulverizing medium directly held in contact with the upper surface of the slit member is hardly moved to consequently cause the slit member to be clogged by the pulverized product.

[Result 2]

The particle diameter of the pulverized product of #8 quartz sand fed and pulverized at a rate of 6 kg/h is shown below.

average diameter X50=1.61 $\mu$m maximum diameter X100=10.55 $\mu$m

[Result 3]

The particle diameter of the finely pulverized product of #8 quartz sand pulverized and sorted by a dry-type forced swirling air classifier 106 as shown in FIG. 4 is shown below.

average diameter X50=0.64 $\mu$m maximum diameter X100=2.63 $\mu$m

The raw material of #8 quartz sand was fed at a rate of 6 kg/h to produce a finely pulverized product at a rate of 1.4 kg/h.

[Result 4]

Figure 7:
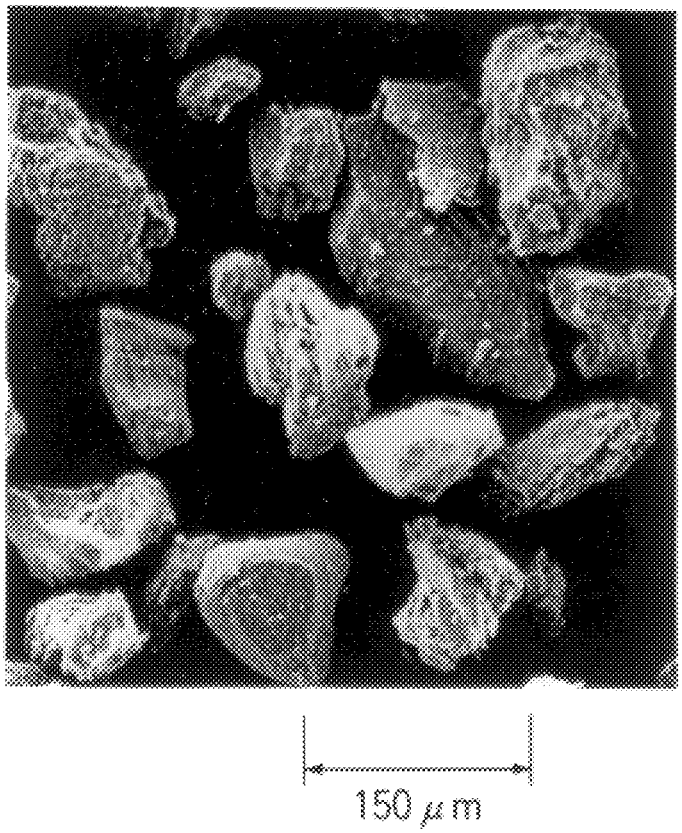
FIG. 7 is a photographic view of particles of #8 quartz sand taken through an electronic microscope with a magnification of 200 before processing the quartz sand by a pulverulent body processing apparatus according to the invention.
Figure 8:
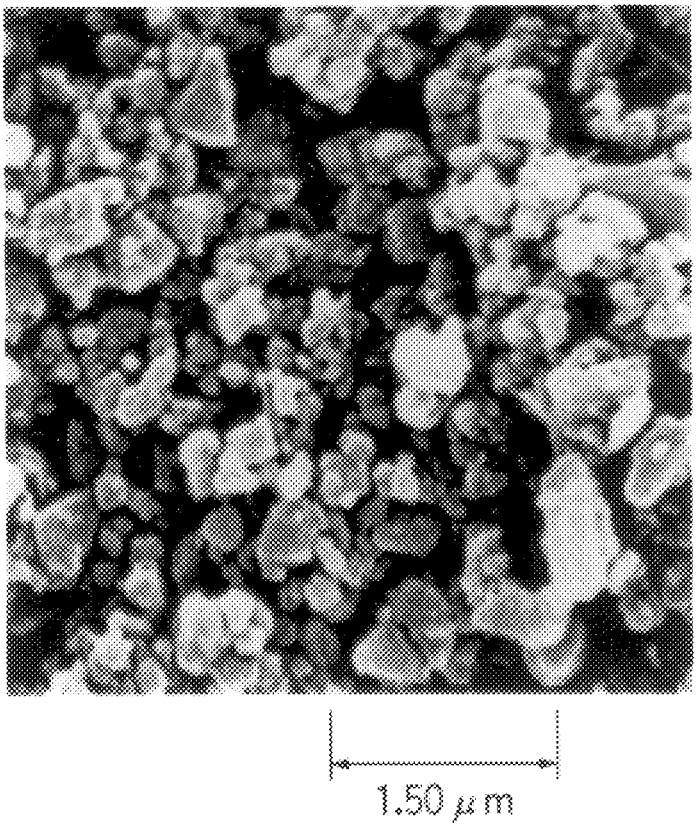
FIG. 8 is a photographic view of ultra-fine particles of #8 quartz sand taken through an electronic microscope with a magnification of 20,000 after pulverizing the quartz sand by a pulverulent body processing apparatus according to the invention.

FIGS. 7 and 8 are photographs of particles taken through a JSM-T100 scan-type electronic microscope (available from JEOL) and a S-2500 scan-type electronic microscope (available from Hitachi, Ltd.) before and after the process of pulverization respectively. When processed by a pulverulent body processing apparatus according to the invention, particles of pulverized product are rounded to show desired optimum profiles as illustrated in FIG. 8.

[Result 5]

A pulverulent body processing apparatus according to the invention can be suitably used to produce a compounded pulverulent body.

(1) compounding of lime stone and titanium dioxide

Lime stone was used as mother particles and compounded with child particles of titanium dioxide.

<1> mother particles . . . lime stone (particle size less than 2 $\mu$m) compounded to a ratio of 80%

Figure 9:
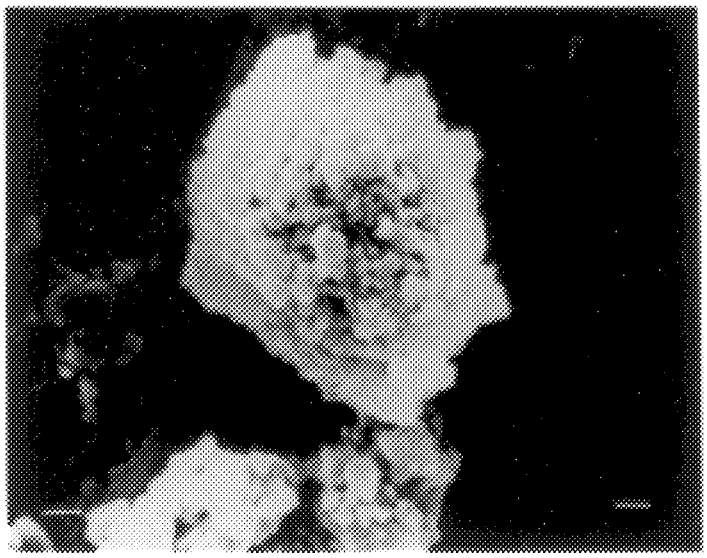
FIG. 9 is a photographic view of compounded ultra-fine particles of lime stone and titanium dioxide taken through an electronic microscope with a magnification of 10,000 after pulverizing the lime stone and titanium dioxide by a pulverulent body processing apparatus according to the invention, using the lime stone as a mother pulverulent member and the titanium oxide as a child pulverulent member.

<2> child particles . . . titanium dioxide (JA-1: tradename, available from Teika Co., Ltd., average particle size X50=0.2–0.3 $\mu$m) compounded to a ratio of 20% <3> state of compounding . . . FIG. 9 shows a photograph of a compounded particle taken through a scan-type electronic microscope. It is seen from the picture that child particles of titanium dioxide are evenly adhering to the surface of a mother particle of lime stone to prove a successful compounding.

(2) compounding of #8 quartz sand and titanium dioxide #8 quartz sand was used as mother particles and compounded with child particles of titanium dioxide. <1> mother particles . . . #8 quartz sand (average particle size X50=83 μm) compounded to a ratio of 80% <2> child particles . . . titanium dioxide (JA-1: tradename, available from Teika Co., Ltd., average particle size X50=0.2–0.3 μm) compounded to a ratio of 20% <3> state of compounding . . . It was observed that child particles of titanium dioxide were evenly adhering to the surface of mother particles of #8 quartz sand to prove a successful compounding as in the case of FIG. 9.

[Result 6]

Figure 10:
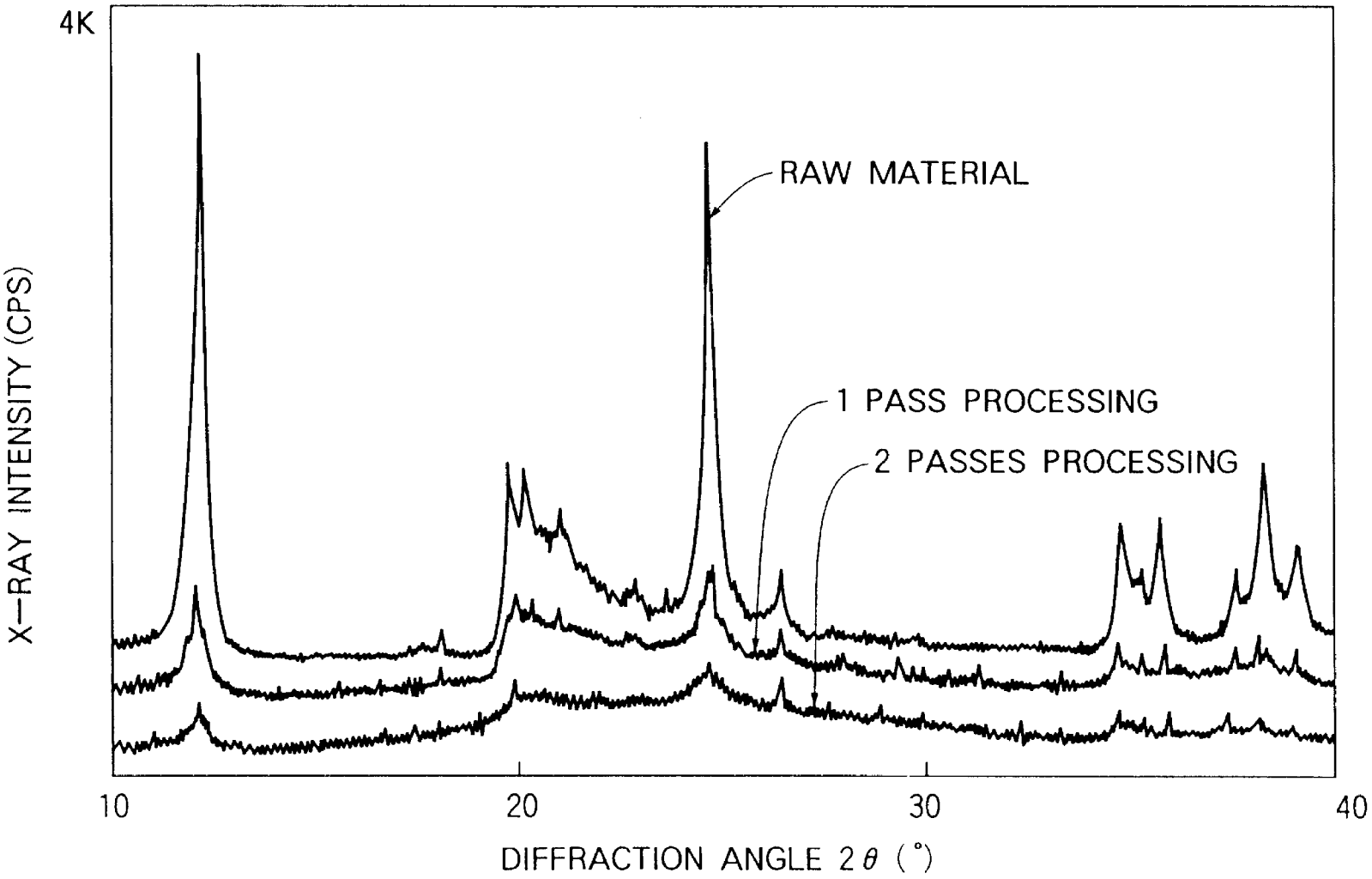
FIG. 10 is a graph schematically showing the result of an X-ray diffraction analysis of a pulverulent body of powdery kaolin pulverized and modified by a pulverulent body processing apparatus according to the invention.

A pulverulent body processing apparatus according to the invention can be effectively used for modifying a pulverulent body. FIG. 10 is a graph showing a result of an analysis carried out by using an X-ray diffraction apparatus CN4037A1 [2kW] available from Rigakudenki Co., Ltd. on a processed product of kaolin powder treated at a rate of 2 kg/h after one pass and two passes. In FIG. 10, the horizontal axis represents the diffraction angle 2θ[°] and the vertical axis represents the intensity of X-ray [CPS]. As seen from FIG. 10, the X-ray diffraction line of the raw material shows sharp peaks to prove that the product had a clear crystalline structure. On the other hand, those of the processed product have lowered peaks to prove that the product were amorphous to a great extent. Note that the product was amorphous to a greater extent after two passes than after one pass. In other words, the extent of amorphousness of the processed product is raised as the number of passes increases.

The more kaolin becomes amorphous, the more it gets to be soluble and weather resistant to improve its quality. This phenomenon may be dependent not only on the extent of amorphousness but also on the mechanochemical effect that appears during the processing operation. Anyway, the X-ray diffraction analysis tells that the quality of kaolin powder can be improved by processing it with a pulverulent body processing apparatus according to the invention and the extent of modification of kaolin can be determined by an X-ray diffraction analysis.

Modification of powdery substances by means of a pulverulent body processing apparatus according to the invention is not limited to kaolin powder but it may be applicable to a variety of powdery substances and the extent of amorphousness, the chemical responsiveness and the adsorbability of such substances can be improved by increasing the number of passes.

What is claimed is:

1. A pulverulent body processing apparatus comprising:

a vertically arranged cylindrical housing;

a slit member having at least one slit sized to prevent unit members of a pulverizing medium from passing therethrough and arranged at the bottom of the cylindrical housing;

a rotary shaft arranged along the axis of the cylindrical housing; and at least one bladed stirring member secured to the rotary shaft, wherein:

the front end of said at least one bladed stirring member and the inner wall of the cylindrical housing have a relationship of $$2 \leqq wh/Db < 16,$$

where wh is the distance between the front end of the bladed stirring member and the inner wall of the cylindrical housing and Db is the maximum diameter of each unit member of the pulverizing medium.

2. A pulverulent body processing apparatus according to claim 1, characterized in that a plurality of vertically arranged bladed stirring members are provided.

3. A pulverulent body processing apparatus according to claim 1, characterized in that a number of vertically bladed stirring members and the same number of obliquely bladed stirring members for stirring up the pulverizing medium are alternately arranged in a vertical direction.

4. A pulverulent body processing apparatus comprising:

a vertically arranged cylindrical housing;

a slit member having at least one slit sized to prevent unit members of a pulverizing medium from passing therethrough and arranged at the bottom of the cylindrical housing;

a rotary shaft arranged along the axis of the cylindrical housing; and a plurality of bladed stirring members arranged vertically and secured to the rotary shaft, wherein:

the lower edge of the lowest bladed stirring member and the slit member have a relationship of $$1.5 < wb/Db < 8,$$

where wb is the distance between the lower edge of the lowest bladed stirring member and the upper surface of the slit member and Db is the maximum diameter of each unit member of the pulverizing medium.

5. A pulverulent body processing apparatus according to claim 4, wherein the number of said bladed stirring members is at least two.

6. A pulverulent body processing apparatus according to claim 5, characterized in that a number of vertically bladed stirring members and the same number of obliquely bladed stirring members for stirring up the pulverizing medium are alternately arranged in a vertical direction.

7. A pulverulent body processing apparatus according to claim 4, wherein the slit member comprises a flat disc, and wherein said at least one slit has a radial width sized to prevent unit members of the pulverizing medium from passing therethrough and a peripheral width greater than the radial width.

8. A pulverulent body processing apparatus comprising:

a vertically arranged cylindrical housing;

a flat disc arranged at the bottom of the cylindrical housing and having a plurality of concentric circular slits arranged therein, the slits being sized to prevent unit members of a pulverizing medium from passing therethrough and a peripheral width greater than the radial width;

a rotary shaft arranged along the axis of the cylindrical housing; and a plurality of bladed stirring members arranged vertically and secured to the rotary shaft.

9. A pulverulent body processing apparatus according to claim 8, wherein said slit has a trapezoidal cross section having a large bottom edge.

10. A pulverulent body processing apparatus according to claim 8, further comprising a radially extending reinforcing member provided under the lower surface of the flat disk.

11. A pulverulent body processing apparatus comprising:

a vertically arranged cylindrical housing;

a flat disc arranged at the bottom of the cylindrical housing and having a single spiral slit arranged therein, the slit being sized to prevent unit members of a pulverizing medium from passing therethrough and a peripheral width greater than the radial width;

a rotary shaft arranged along the axis of the cylindrical housing; and a plurality of bladed stirring members arranged vertically and secured to the rotary shaft.

12. A pulverulent body processing apparatus according to claim 11, wherein said slit has a trapezoidal cross section having a large bottom edge.

13. A pulverulent body processing apparatus according to claim 11, further comprising a radially extending reinforcing member provided under the lower surface of the flat disk.

* * * * *

UNITED STATES PATENT AND TRADEMARK OFFICE

CERTIFICATE OF CORRECTION

PATENT NO. : 5,769,338

DATED : June 23, 1998

INVENTOR(S) : Saburoh Yashima; Manabu Abe; Katsumi Ueta; Kantaro Kaneko

It is certified that error appears in the above-identified patent and that said Letters Patent is hereby corrected as shown below:

On the title page of the patent, please change first assignees name to read as follows:

--Fimatec Ltd.--

Signed and Sealed this

First Day of September, 1998

Bruce Lehman

*Attest:*

BRUCE LEHMAN

*Attesting Officer*

*Commissioner of Patents and Trademarks*